United States Patent [19]

Shiratori

[11] 4,327,916

[45] May 4, 1982

[54] GOLF CLUB

[76] Inventor: Yukio Shiratori, 15432 Harvard Blvd., Gardena, Calif. 90247

[21] Appl. No.: 120,051

[22] Filed: Feb. 11, 1980

Related U.S. Application Data

[62] Division of Ser. No. 915,618, Jun. 15, 1978, Pat. No. 4,212,467.

[51] Int. Cl.[3] ..... A63B 69/36; A63B 53/10

[52] U.S. Cl. ..... 273/163 A; 273/80 R; 273/183 D; 273/DIG. 14

[58] Field of Search ..... 273/68, 77 R, 80 R, 273/80 B, 80.9, 162 R, 162 B, 163 R, 163 A, 164, 183 D, 183 E, 186 R, 186 A, 193 R, 194 R, DIG. 14, 32 R, 32 H; 33/173, 174 F, 263, 265, 293, 295, 365, 391, 392

[56] References Cited

U.S. PATENT DOCUMENTS

| | | | |
|---|---|---|---|
| 1,218,091 | 3/1917 | Lard | 273/80 B X |
| 2,099,126 | 11/1937 | Larsen | 273/80 R X |
| 2,236,414 | 3/1941 | Reach | 273/80 A X |
| 2,293,312 | 8/1942 | Sewell | 273/DIG. 14 |
| 2,919,491 | 1/1960 | Darrell et al. | 273/162 B X |
| 3,186,092 | 6/1965 | Bertas | 273/163 A X |
| 3,806,133 | 4/1974 | Cork | 273/80 R X |
| 3,974,012 | 8/1976 | Hogarth | 273/80 R X |
| 4,212,693 | 7/1980 | Saito et al. | 273/DIG. 14 |

OTHER PUBLICATIONS

"Popular Mechanics"; Jul. 1959; p. 124.

*Primary Examiner*—Richard J. Apley
*Attorney, Agent, or Firm*—Finkelstein, McGuire & Thut

[57] ABSTRACT

A golf club arrangement provided with means for "reading" the green. The shaft of the golf club is provided with at least a transparent portion extending in the longitudinal direction thereof. The transparent portion has an indicia such as an opaque line extending along the longitudinal direction and may be either on the surface or internal the transparent portion of the shaft. When the club is held vertically and the green observed through the transparent portion the natural lie of the grass can be more easily seen by reference to the angle made by the grass with the indicia.

4 Claims, 20 Drawing Figures

FIG. 2.
FIG. 3.
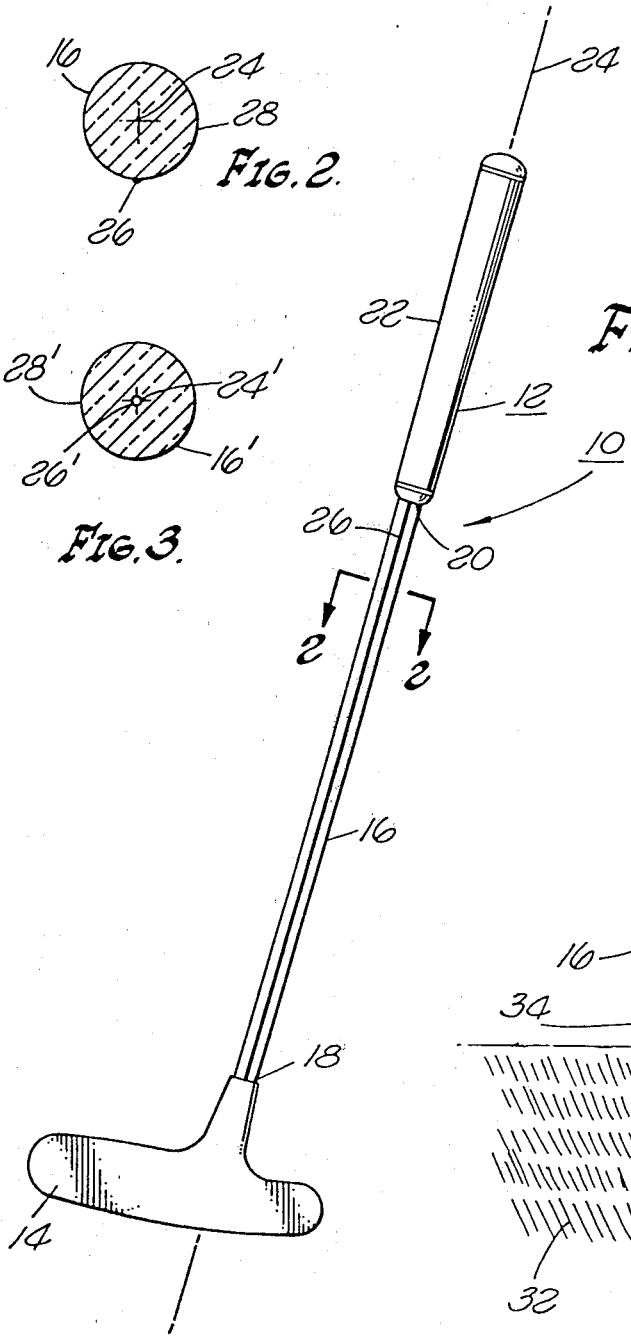
FIG. 1.
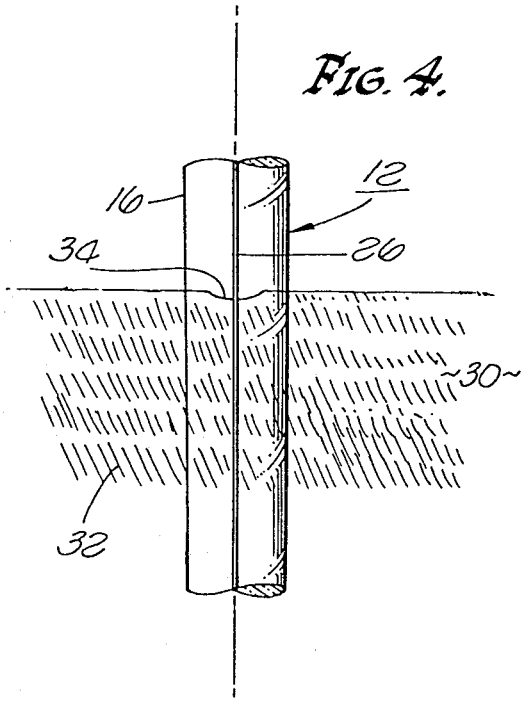
FIG. 4.

FIG. 6
FIG. 7
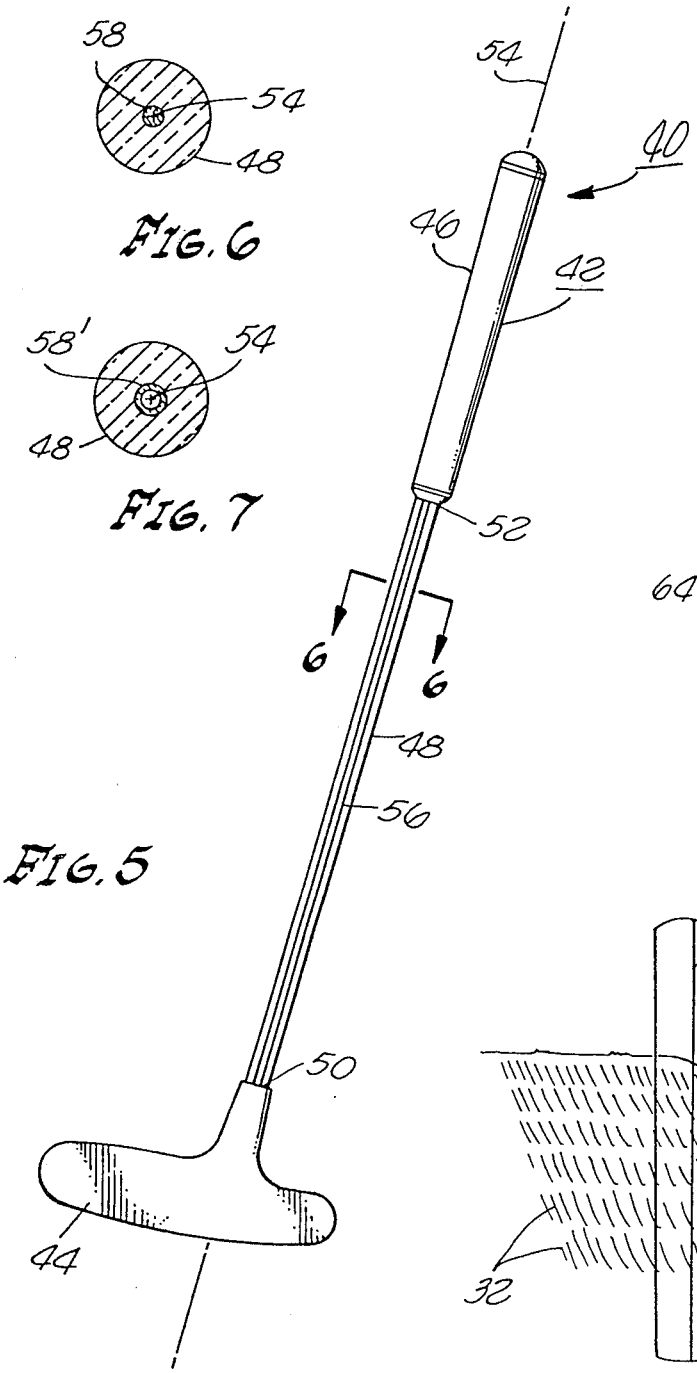
FIG. 5
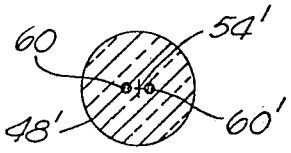
FIG. 8
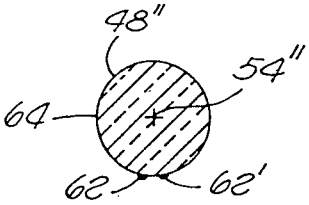
FIG. 9
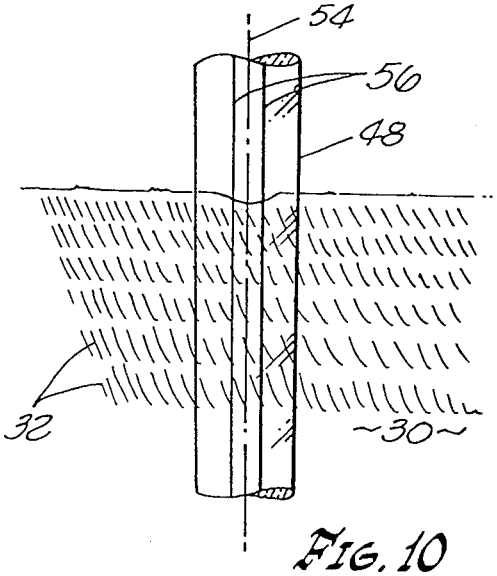
FIG. 10

FIG. 16
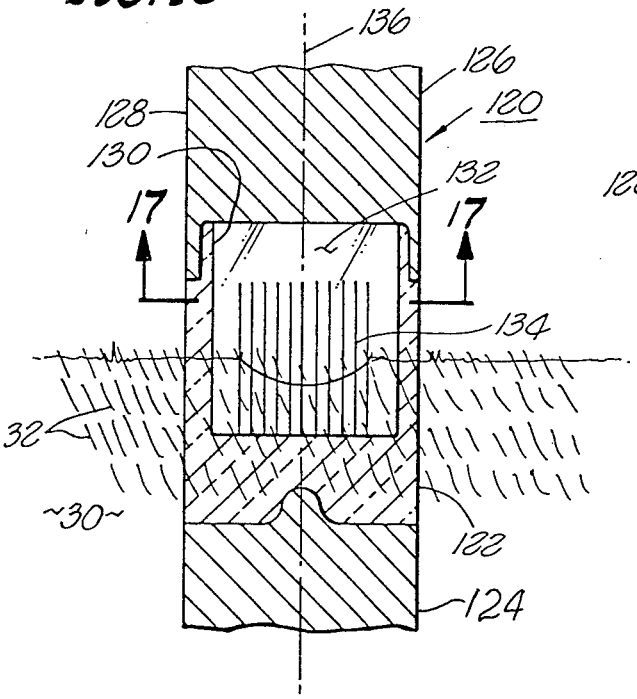
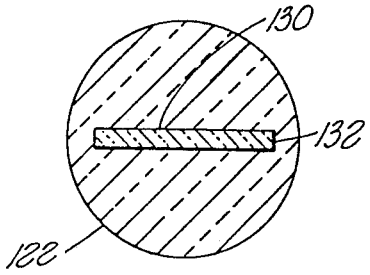
FIG. 17
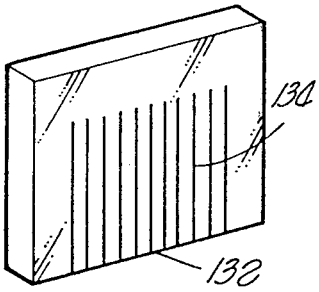
FIG. 18
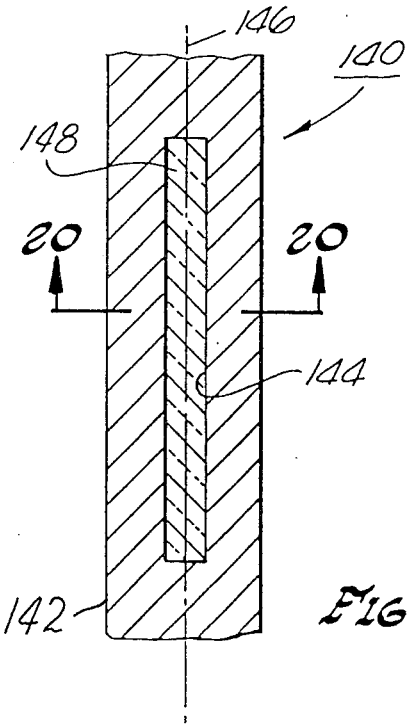
FIG. 19
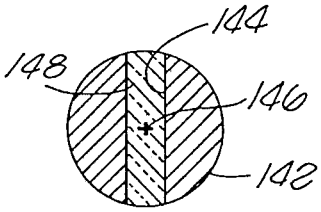
FIG. 20

GOLF CLUB

This is a division of application Ser. No. 915,618, filed June 15, 1978, now U.S. Pat. No. 4,212,467, issued July 15, 1980.

BACKGROUND OF THE INVENTION

1. Field of the Invention

This invention relates to the golf club art and more particularly to an improved golf club arrangement for aiding in reading the "break" in a green.

2. Background of the Invention

In the game of golf, one important aspect, of course, is that portion of the game comprised of putting. During the putting portion of the golf game the golf ball rests upon the green which also contains the cup or hole. In most golf courses the green is a well gardened and tended area and, it has been found, the grass of the green has a natural lie or break. That is, the grass does not grow completely vertical but tends to lean, in general, in one particular direction. Thus, a golf ball putted on the green will tend to be deflected from its course in the direction of the lean of the grass. This is generally termed the lie or break of the green. The ability to be able to read the lie or break in the green becomes important in the ability of the golfer to be able to judge accurately the path that the golf ball will take after being struck toward the cup as well as aiding in determining the force with which the golfer must strike the ball.

Reading of the green has, in the past, not heretofore been generally successfully done. Many golfers hold a golf club, such as a putter, vertical in an attempt to sight the green along the edge of the golf club in an attempt to determine the break of the green. Other golfers examine the green at quite close proximity for example sighting along the green from the ball toward the cup in an attempt to read the green. Such activities have not heretofore provided as accurate a reading of the green as desired in order to be able to give the golfers information upon which to base both the directioon and force with which the golf ball must be putted.

Accordingly, there has long been a need in golfing for a golf club which incorporates means for enabling the golfer to judge more accurately the particular lie of the green between the position of the golf ball and the cup.

SUMMARY OF THE INVENTION

Accordingly, it is an object of the present invention to provide an improved golf club.

It is an object of the present invention to provide a golf club incorporating means for aiding in reading the green.

It is another object of the present invention to provide a golf club, generally a golf club putter, which incorporates means for allowing the golfer to visually determine the break of the green between the golf ball and the cup.

The above, and other objects, are achieved, according to a preferred embodiment of the present invention, by providing a golf club, such as a golf club putter, which incorporates a club head having a face for striking the golf ball. The golf club has an elongated longitudinally extending shaft connected to the head and the remote end of the shaft is provided with a grip means. Both the grip means and the club head may be of any desired configuration.

The shaft means comprises a transparent portion located intermediate the club head and the grip means. The transparent portion may extend all or substantially all of the longitudinal distance between the grip means and the club head or only a portion thereof. The transparent portion is provided with indicia means which extend a predetermined longitudinal distance along the transparent portion. The indicia means may appear to the golfer to be a line or a plurality of lines which are less transparent than the remainder of the transparent portion. The indicia means may be on the external surface of the transparent portion or positioned interior. Thus, the indicia means may comprise a straight line extending along the peripheral surface of the transparent portion in the longitudinal direction. Alternatively, the indicia means may comprise a thin wire interior the transparent portion, for example, lying along the longitudinal axis of the shaft. Thus, where a single indicia means is provided it is preferably positioned in a plane containing the longitudinal axis of the shaft.

The indicia means may also be provided by a plurality of lines on the peripheral surface of the shaft which lines are parallel to the longitudinal axis.

In another embodiment of the present invention the indicia means may be provided by a tube or rod positioned coaxially with the longitudinal axis of the shaft and the tube or rod may have any desired diameter to provide the indicia. Because of defraction occurring at the interface between the tube or rod and the remainder of the transparent portion, the edges of the tube or rod will appear to be opaque giving the visual appearance of a pair of lines.

In yet another embodiment of the present invention the indicia means is provided by a plurality of parallel appearing lines, parallel to the longitudinal axis of the shaft and which lines may be on the peripheral surface or internal the transparent portion.

In yet another embodiment of the present invention a slot may be cut into the shaft of a predetermined width and predetermined longitudinal length and preferably comparatively narrow in width. The slot may then be filled, if desired, with a transparent material and the edges of the slot providing the interface between the shaft and the transparent material provides the indicia means. Alternatively, the slot may be left open.

In utilizing the golf club of the present invention, the golfer holds the golf club so that the longitudinal axis of the shaft is vertical and looks at the green through the transparent portion. The indicia means provided on the transparent portion are thus vertical and the angle that, in general, the grass of the green makes with the indicia means indicates the break of the green. The greater the angle, it has been found, the greater will be the break and thus the golfer may determine both the direction and estimate the force with which to strike the ball in order to drive it to the cup taking into account both the break and the amount of break inherent in the green.

BRIEF DESCRIPTION OF THE DRAWINGS

The above and other embodiments of the present invention may be more fully understood from the following detailed description taken together with the accompanying drawings wherein similar reference characters refer to similar elements throughout and in which:

FIG. 1 illustrates a golf club according to the principles of the present invention;

FIG. 2 is a sectional view along the line 2—2 of FIG. 1;

FIG. 3 illustrates another embodiment of the present invention;

FIG. 4 illustrates utilization of the embodiment shown in FIG. 1;

FIG. 5 illustrates another embodiment of the present invention;

FIG. 6 is a sectional view along the line 6—6 of FIG. 5;

FIGS. 7, 8 and 9 each illustrate other embodiments of the present invention;

FIG. 10 illustrates utilization of the embodiment shown in FIG. 6 of the present invention;

FIG. 16 illustrates another embodiment of the present invention;

FIG. 17 is a sectional view along the line 17—17 of FIG. 16;

FIG. 18 illustrates an indicia bearing means useful in the practice of the embodiment shown in FIG. 16;

FIG. 19 illustrates another embodiment of the present invention; and

FIG. 20 is a sectional view along the line 20—20 of FIG. 19.

DESCRIPTION OF THE PREFERRED EMBODIMENTS

Figure 12:
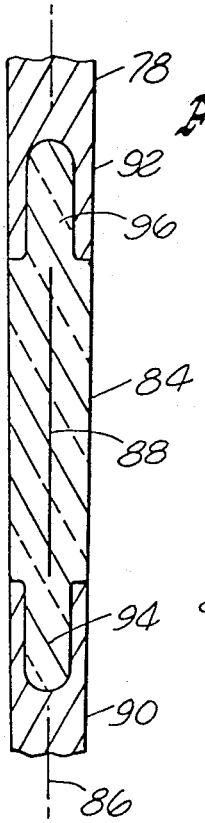
FIG. 12 illustrates a method of attaching a transparent portion into the shaft of a golf club according to the principles of the present invention.

Referring now to the drawing, there is illustrated, in FIG. 1, an embodiment, generally designated 10 of the golf club generally designated 12 according to the principles of the present invention. In the embodiment 10 the golf club is depicted as a putter. However, it will be appreciated, the present invention is not limited to incorporation in a putter but may be incorporated in any desired golf club.

The golf club 12 is provided with a club head 14, an elongated longitudinally extending shaft means 16 having a first end 18 coupled to the club head 14 and a second end 20 coupled to the grip means 22. The club head 14 and the grip means 22 may be of any desired configuration and do not per se, form the present invention.

The elongated longitudinally extending shaft means 16 has a longitudinal axis 24. In the embodiment 10 shown in FIG. 1 the shaft means 16 is fabricated from a transparent material such as plastic or the like and is provided with indicia means 26 extending between the grip means 22 and the club head 24. The indicia means 26 is less transparent than the remainder of the shaft means 16 and, for example, may be opaque. Preferably, the indicia means 26 appears as a thin line lying in a plane containing the longitudinal axis 24 of the shaft means 16. The indicia means 26, may, as illustrated in FIG. 2, comprise a thin line on the external peripheral surface 28 of the shaft means 16. Alternatively, as illustrated in FIG. 3, the indicia means 26′ as shown thereon may comprise a thin wire embedded internal the transparent shaft means 16′ and along the longitudinal axis 24′ thereof.

Utilization of the golf club 12 according to the principles of the present invention is illustrated in FIG. 4. As shown in FIG. 4 the golf club 12 is held so that the shaft means 16 is vertical and the golfer views the green generally designated 30 therethrough. The grass 32 of the green has, as illustrated in FIG. 4 a natural growth whereby it leans toward the left as shown on FIG. 4. By viewing the grass 32 through the transparent shaft means 16 the angle that the grass 32 makes with the indicia means 26 may be observed. Thus, as shown in FIG. 4 the green 30 has a natural break or lie to the left. Thus, a golf ball putted toward the cup 34 on the green 30 will have a natural tendency to break toward the left since the resistence of the grass 32 is less in the direction of the break or lie of the grass 32. The greater the angle that the grass 32 makes with the indicia means 26 the greater will be the tendency of the golf ball putted toward the cup 34 to break or move from a straight line toward the left and therefore there is a greater resistance to the ball traveling toward the right. Therefore, the golfer may estimate from the visual appearance of the grass 32 of the green 30 through the transparent portion of the shaft means 16 both the direction of the break as well as the amount of the break and therefore may estimate both the direction and force needed to propel the golf ball from a given location toward the cup 34.

FIG. 5 illustrates another embodiment generally designated 40 according to the principles of the present invention. As shown in FIG. 5 the golf club 42 which may be generally similar to the golf club 12 depicted in FIG. 1, is provided with a club head 44 and a grip means 46. An elongated longitudinally extending shaft means 48 is provided having a first end 50 coupled to the club head 44 in a second end 52 at the grip 46. The shaft means 48 has a longitudinal axis 54 and, in the embodiment 40, the shaft means 48 is transparent between the first end 50 and second end 52. In the embodiment 40 the indicia means 56 appears as a pair of parallel lines. This appearance of the pair of parallel lines may be provided, for example, as illustrated in FIG. 6 by providing a rod 58 coaxially aligned with the longitudinal axis 54 internal the transparent shaft means 48. The rod 58 may be opaque, or transparent, as desired, and has a predetermined diameter which, for example, may be greater than the thin wire 26′ shown in FIG. 3. The defraction of light at the interface between the rod 58 and the transparent shaft means 48 gives the appearance of the two parallel lines comprising the indicia means 56 illustrated in FIG. 5 when the rod 58 is transparent.

Alternatively, as illustrated in FIG. 7, the rod 58 may be replaced by a tube 58′ coaxially aligned with the longitudinal axis 54 of the shaft means 48 and, once again, the defraction of light at the interface between the external peripheral surface of the tube 58′ and the transparent shaft means 48 provides the appearance of the two parallel lines defining the indicia means 56. The tube 58′ may have any desired wall thickness and may be opaque or transparent, as desired. When the tube 58′ is opaque, of course, the space between the two parallel appearing lines defining indicia means 56 is also opaque.

The provision of two parallel lines as the indicia means 56 may also be provided as illustrated in FIGS. 8 and 9. As shown in FIG. 8 the shaft means 48′ is provided with two thin wires 60 and 60′ internal thereof lying in a plane containing the longitudinal axis 54′ of the shaft means 48'. The two thin wires 60 and 60' may be similar to the wire 26' shown in FIG. 3.

FIG. 9 illustrates another arrangement for providing the two parallel appearing indicia means 56 shown in FIG. 5. As shown in FIG. 9, the shaft means 48" may be provided with a pair of lines 62 and 62' spaced a preselected distance apart on the external surface 64 of the shaft means 48". Each of the lines 62 and 62' may be similar to the line 26 illustrated in FIG. 2 and each lies in a plane containing the longitudinal axis 54" of the shaft means 48".

FIG. 10 is an illustration, generally similar to FIG. 4 illustrating utilization of the embodiments shown in FIG. 5, 6, 7, 8 and 9. As can be seen from FIG. 10, the green 30 may be viewed through the transparent shaft, for example, shaft 48 with the longitudinal axis 54 thereof in a vertical orientation. The angle that the grass 32 makes with the indicia means 56 comprising the two parallel appearing lines provides additional accuracy in measuring both the angle and direction of the natural lie of the grass 32, as described above.

Figure 11:
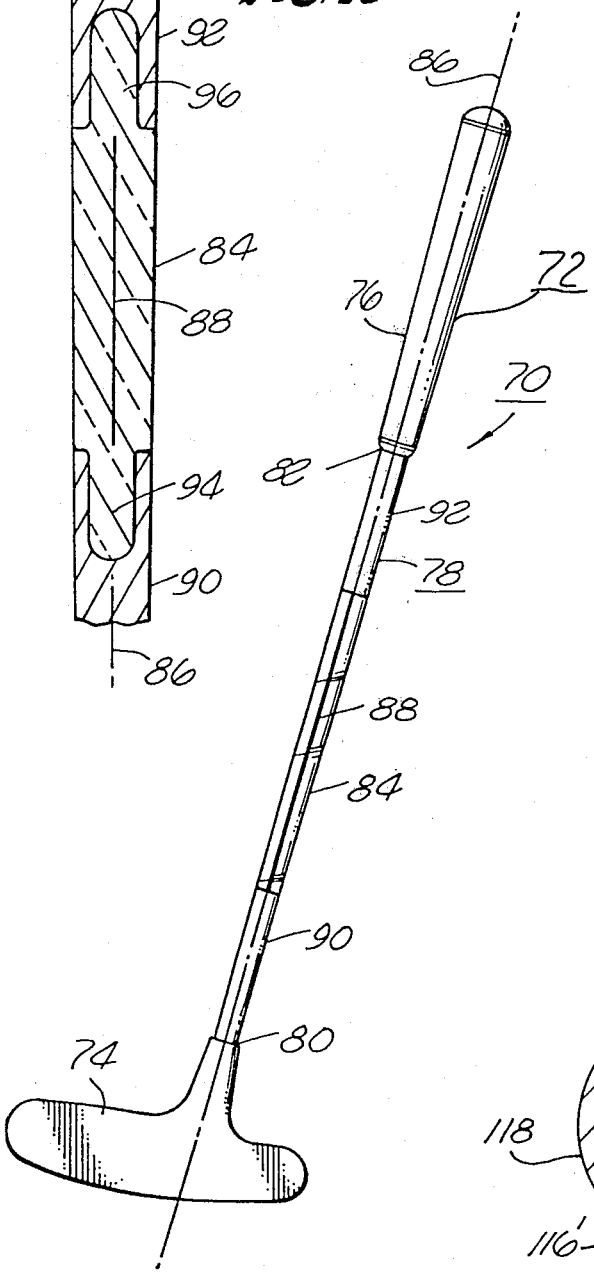
FIG. 11 illustrates another embodiment of the present invention.

Referring now to FIG. 11 there is illustrated another embodiment generally designated 70 according to the principles of the present invention. The embodiment 70 comprises a golf club 72 having a club head 74, which may be similar to the club heads 14 and 44 described, and a grip means 76 which may be similar to the grip means 22 and 46 described above. In the embodiment 70 there is provided a shaft means 78 having a first end 80 coupled to the club head 74 and a second end 82 coupled to the grip means 76. In the embodiment 70, however, the shaft means 78 is provided with a transparent portion 84 intermediate the club head 74 and grip means 76 and the transparent portion 84 does not extend from the first end 80 to the second end 82. Preferably, the transparent portion 84 extends in the longitudinal direction defined by the longitudinal axis 86 of the shaft means 78 approximately one to two feet, though greater or lesser lengths of the transparent portion 84 may be provided as desired. The transparent portion 84 has an indicia means 88 thereon and it may be similar to any of the indicia means illustrated in FIGS. 1 through 10 above. The transparent portion 84 may, if desired, be fabricated from a clear plastic and coupled to opaque solid portions 90 and 92 of the shaft means 78. FIG. 12 is a sectional view of the shaft means 78 illustrating a preferred arrangement for coupling the transparent portion 84 to the solid opaque portions 90 and 92 of the shaft means 78. As illustrated on FIG. 12 the transparent portion 84 is provided with protruding members 94 and 96 at opposite longitudinal ends thereof which are received in corresponding sockets of the portions 90 and 92 respectively. They may be bonded in place or otherwise securely attached thereto as desired.

Figure 13:
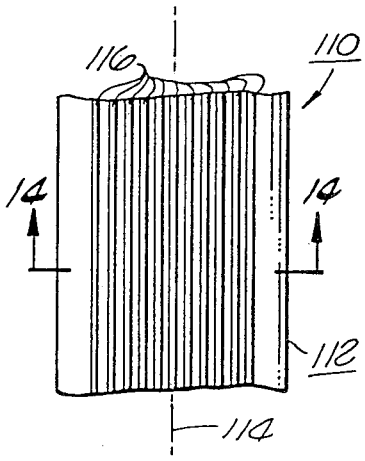
FIG. 13 illustrates another embodiment of the present invention.
Figure 14:
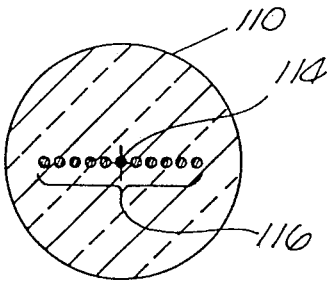
FIG. 14 is a sectional view along the line 14—14 of FIG. 13.
Figure 15:
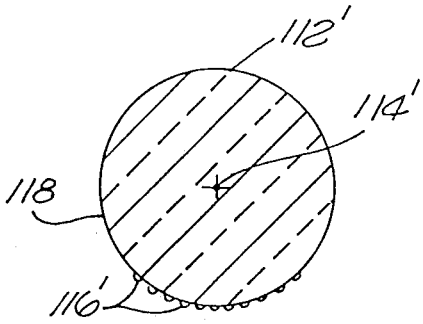
FIG. 15 illustrates another embodiment of the present invention.

FIG. 13 illustrates another embodiment generally designated 110 of a golf club according to the principles of the present invention. FIG. 13 illustrates a section of the transparent portion 112 of such a golf club, which for example, may be incorporated in structure as illustrated in FIG. 1 or FIG. 11 as desired. The transparent portion 112 forms part of the shaft of the golf club and has a longitudinal axis 114. The indicia means 116, in the embodiment 110 is comprised of a plurality of parallel lines extending parallel to the longitudinal axis 114 and lying in a plane containing the longitudinal axis 114. FIG. 14 is a sectional view through the embodiment 110 and illustrates the indicia means 116 comprised of a plurality of thin wires such as the thin wire 26' illustrated in FIG. 3 embedded in the transparent portion 112 and all lying in a plane containing the longitudinal axis 114. Alternatively, the indicia means 116 may be provided by a plurality of lines 116' lying on the external surface 118 of a transparent portion 112' in a manner similar to that shown for the indicia means 26 in FIG. 2 and 62 and 62' shown in FIG. 9. Each of the indicia means 116' lies in a plane containing the longitudinal axis 114' of the transparent portion 112' shown in FIG. 15.

FIG. 16 illustrates yet another embodiment generally designated 120 of the present invention in which a transparent portion 122 may be incorporated in the shaft of a golf club such as that illustrated in FIG. 11 wherein the transparent portion 122 only extends a portion of the distance between two solid portions 124 and 126 of the shaft means 128. In the embodiment illustrated in FIG. 16 the transparent portion 122 is provided with walls defining a slot 130 into which an indicia member 132 is inserted. The indicia member 132 has the indicia means 134 thereon which, for example, may be one or more parallel lines extending in the direction of the longitudinal axis 136 of shaft means 128. The transparent portion 122 is coupled to the portions 124 and 126 by bonding or any other desired means. FIG. 17 is a sectional view along the line 17—17 of FIG. 16 and illustrates how the indicia member 132 fits into the slot 130 of the transparent portion 122. FIG. 18 illustrates the indicia member 132 having the indicia 134 thereon. The indicia member 132 may be cast in place if the transparent portion 122 is cast or otherwise inserted into a slot provided in the transparent portion 122.

FIGS. 19 and 20 illustrate yet another embodiment of the present invention generally designated 140 in which a golf club shaft 142 is provided with walls 144 defining a slot extending therethrough for a predetermined longitudinal length along the longitudinal axis 146. The slot defined by the walls 144 may be filled with a transparent member 148. Alternatively, the slot may be left open. The walls 144 of the slot provide the indicia means when utilized in accordance with the principles of the present invention as described above. Alternatively, one or more indicia means may be provided either internal the transparent portion 148 along the longitudinal axis 146 or in a plane containing the longitudinal axis 146 or on the external surface of the transparent portion 148 in a manner as described above.

From the above it can be seen that there has been provided an improved golf club arrangement which enables the golfer to read the green and determine the natural break thereof. Such reading of the green thus allows the golfer to estimate more accurately both the direction that the ball will travel when being putted toward the cup as well as the amount of force necessary to propel the ball toward the cup. Those skilled in the art may find many variations and adaptations of the present invention and all such variations and adaptations falling within the true scope and spirit are intended to be covered by the appended claims.

I claim:

1. In a golf club, the improvement comprising, in combination:

a club head;

an elongated longitudinally extending substantially cylindrical shaft means having a first end coupled to said club head, and a second end;

a grip means coupled to said second end of said shaft means;

said shaft means having a predetermined longitudinal axis extending between said grip means and said club head; and said shaft means comprising:

planar walls in planes parallel to each other and parallel to said longitudinal axis defining a slot extending through said shaft means intermediate said club head and said grip means and extending for a predetermined longitudinal length along said shaft means and said walls providing opaque visual indicia means; and a solid transparent member filling said slot and having a peripheral surface.

2. The arrangement defined in claim 1 and further comprising opaque indicia means internal said solid transparent member and extending along said longitudinal axis of said shaft means.

3. The arrangement defined in claim 1 and further comprising opaque indicia means internal said solid transparent member and located in a plane containing said longitudinal axis of said shaft means.

4. The arrangement defined in claim 1 and further comprising opaque indicia means on said peripheral surface of said solid transparent member and located in a plane containing said longitudinal axis of said shaft means.

* * * * *